US008230800B1

(12) United States Patent
Wing et al.

(10) Patent No.: US 8,230,800 B1
(45) Date of Patent: Jul. 31, 2012

(54) WATERCRAFT FLOTATION DEVICE USING DRAWSTRING ATTACHMENT

(75) Inventors: William W. Wing, Arcata, CA (US); Jess E. Walls, Bayside, CA (US); Michael Kroemer, Eureka, CA (US)

(73) Assignee: Wing Inflatables, Inc., Arcata, CA (US)

( * ) Notice: Subject to any disclaimer, the term of this patent is extended or adjusted under 35 U.S.C. 154(b) by 340 days.

(21) Appl. No.: 12/761,950

(22) Filed: Apr. 16, 2010

Related U.S. Application Data

(60) Provisional application No. 61/222,427, filed on Jul. 1, 2009.

(51) Int. Cl.
*B63B 43/14* (2006.01)

(52) U.S. Cl. ..... 114/123

(58) Field of Classification Search ..... 114/219, 114/345, 123, 343, 352–354
See application file for complete search history.

(56) References Cited

U.S. PATENT DOCUMENTS

| | | | | |
|---|---|---|---|---|
| 4,811,682 | A | 3/1989 | Hwang et al. | |
| 5,184,564 | A | 2/1993 | Robbins et al. | |
| 5,651,328 | A * | 7/1997 | Elkington | 114/345 |
| 6,021,729 | A | 2/2000 | DeRuscio | |
| 6,749,475 | B2 | 6/2004 | Howerton | |
| 7,305,931 | B1 | 12/2007 | Benson et al. | |
| 2001/0032578 | A1 | 10/2001 | Mcauliffe | |

* cited by examiner

*Primary Examiner* — Edwin Swinehart
(74) *Attorney, Agent, or Firm* — David Pressman

(57) ABSTRACT

A sponson comprises a floatable tubular section (110) with longitudinal, attached guideways or channels (105, 115) that house drawstrings (106, 116). The sponson is secured to the gunwale (130) of a personal watercraft by positioning a first guideway or channel above the gunwale and a second guideway or channel below the gunwale then pulling the drawstrings tight and securing them with knots (107, 117) or other means. The sponson has been filled with air, a foam material, or a combination in order to provide flotation. It also acts as a bumper to prevent damage to the craft in case of a collision with another object. The sponson is positioned above the water line and so does not cause drag when the craft is in normal use. The design is usable without modification for a variety of craft. An alternative embodiment includes an extra guideway or channel (120) for attachment to a fixture (125) previously installed on a craft.

20 Claims, 1 Drawing Sheet

WATERCRAFT FLOTATION DEVICE USING DRAWSTRING ATTACHMENT

CROSS REFERENCE TO RELATED APPLICATIONS

This application claims priority of provisional patent application Ser. No. 61/222,427, filed 2009 July 1.

BACKGROUND

1. Field

The field is inflatable water sport equipment, and in particular a safety collar for use on jet skis.

2. Prior Art

The following is a list of some prior art that presently appears relevant:

| Pat. or Pub. No. | Kind Code | Issue or Pub. Date | Patentee or Applicant |
|---|---|---|---|
| 4811682 | B1 | Mar. 14, 1989 | Hwang et al. |
| 5184564 | B1 | Feb. 9, 1993 | Robbins et al. |
| 6021729 | B1 | Feb. 8, 2000 | DeRuscio |
| 6749475 | B2 | Jun. 15, 2004 | Howerton |
| 7305931 | B1 | Dec. 11, 2007 | Benson et al. |
| 20010032578 | A1 | Oct. 25, 2001 | Mcauliffe |

Hwang et al. show a mini-yacht for children's use. Flotation is provided by a generally cylindrical, U-shaped inflatable bladder that surrounds the boat on the front and sides. The bladder is detachably connected to the boat body by a flange provided with holes which can receive pins that are secured to the boat.

Robbins et al. show a pontoon for use with a personal vehicle such as a jet ski. The pontoon is U-shaped and surrounds the vehicle on the front and sides. The pontoon includes longitudinal ribs along each of its inner sides that detachably mate with longitudinal members on each side of the vehicle. A transom joins the open ends of the pontoon at the rear of the vehicle.

DeRuscio shows a J-shaped fender for personal watercraft. The fender includes a hook portion that hooks under the bond flange of the watercraft. A suction cup and/or a securing line is provided at the end opposite the hook portion for securing the fender to the watercraft.

Howerton shows a U-shaped flotation device with a stabilizing frame between the parallel legs of the flotation chamber. A rigid, U-shaped stabilizing frame is connected to the flotation chamber by passing through loops secured to the chamber.

Benson et al. show a rigid chambered boat hull with a U-shaped inflatable perimeter that is attached to the hull. A rod-like material passes through a loop of attachment material that is secured to an inflatable chamber. The loop is secured to the hull by fasteners such as pop-rivets. The rod-like material within the loop is inboard of the fasteners and acts to prevent separation of the chamber from the boat.

The above prior-art arrangements all require that the stabilizing member be attached to a predetermined surface of the watercraft, thus limiting their application to one particular watercraft design. The sponsons are often awkward and difficult to attach and remove and the attachment is not as secure as desirable.

SUMMARY

We have discovered a method and apparatus for attaching a sponson or flotation collar to a personal watercraft such as a jet ski. The sponson is easily installed and removed without tools by using a drawstring, and it is adaptable to a variety of watercraft without requiring fixtures for attachment to the body of the craft, thus it can be used with watercraft of more than one design. An alternative embodiment provides a secure attachment to an even greater variety of watercraft.

DRAWING FIGURES

Figure 1:
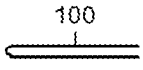
FIGS. 1-3 are cross-sectional views showing the components and steps in assembling a sponson according to a first embodiment.

| REFERENCE NUMERALS | | | |
|---|---|---|---|
| 100 | Sheet | 101 | Flap |
| 102 | Flap | 104 | Portion |
| 105 | Channel or raceway | 106 | Drawstring |
| 107 | Knot | 110 | Tube |
| 115 | Eye | 116 | Drawstring |
| 117 | Knot | 120 | Eye |
| 121 | Portion | 125 | Fixture |
| 130 | Gunwale | | |

PREFERRED EMBODIMENT

Figure 2:
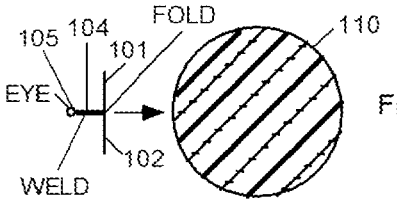
Figure 3:
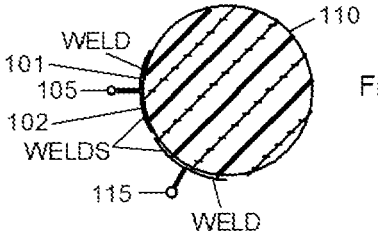

Description—FIGS. 1 through 3

A sponson (variation of expansion) is a buoyant appendage or flotation collar that boaters often attach to the upper edge or gunwale of a watercraft or vessel to aid in flotation, prevent capsizing, and provide collision protection.

FIG. 1 shows a cross-sectional view of a folded sheet 100 of plastic material prior to fabrication into a tie or drawstring guide which will be attached to and form part of a sponson according to one embodiment. Sheet 100 is about 1.5 mm thick. In one application, before being folded for fabrication it had an elongated rectangular shape, about 27 cm wide by about 5.5 meters long, equal to the length of a finished sponson. After a single fold as shown it had a bight at the left side and two parallel leg portions (top and bottom) that extend from the bight.

The sponson comprises an elongated flotation tube which includes a tie guide on one side of the tube, as will be described. The left side of FIG. 2 shows a cross-sectional view of a tie guide made from the folded sheet of FIG. 1 and prior to attachment to the sponson tube. The top and bottom leg portions have been welded together over a portion 104 of their width. Portion 104 occupies only the central part of the leg portions. At the left side of portion 104 the leg portions are not attached so the bight forms an elongated open-ended tube, channel, raceway, or guide 105. At the right side of portion 104 the upper and lower legs have been folded up and down, respectively, at 90° to portion 104 to form two free portions or flaps 101 and 102. After folding and making weld 104, channel 105 was 1.5 cm in diameter, weld 104 was 8 cm wide, and flaps 101 and 102 extended away from weld 104 about 3 cm, although other sizes can be used as required. As indicated by the arrow, flaps 101 and 102 of the now-formed tie guide are thus ready to be attached to a cylinder or tube 110 at the right side of FIG. 2.

Tube 110 is the largest portion of the sponson and comprises a chamber with a durable outer cover and an interior chamber containing a foam material, air, or a combination of air and foam material.

In FIG. 3, the tie guide with channel 105 has been secured to tube 110 by welding flaps 101 and 102 to tube 110. A second and similar tie guide with a channel 115 is also attached to tube 110 by similar welds. The resultant assembly comprises a sponson suitable for attachment to a personal watercraft such as a jet ski. Channels 105 and 115 and their associated welds extend longitudinally along the full length of tube 110.

Figure 4:
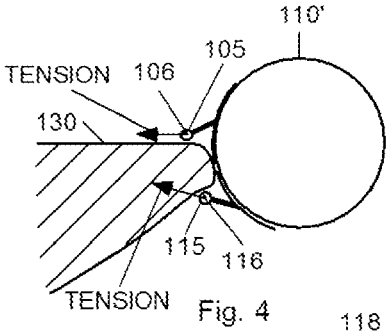
FIG. 4 shows the mounting of a sponson according to the embodiment of FIGS. 1-3.
Figure 5:
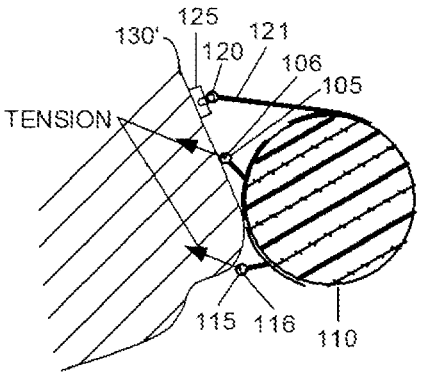
FIG. 5 shows the mounting of a sponson according to one aspect of an alternative embodiment.

The finished sponson comprises tube 110 and two attached tie guides with their longitudinal channels 105 and 115. It is about 30 cm in diameter and 5.5 meters in length, with a wall thickness of 1.5 mm, although other sizes can be used. The outer surface of tube 110 and attached tie guides with channels 105 and 115 are preferably made of urethane-coated, woven nylon fabric or another elastomeric material such as vinyl, reinforced vinyl, or chlorosulfonated polyethylene, sold under the trademark HYPALON by DuPont Chemical Co. of Wilmington, Del. These materials are normally cut using a hot knife and are bonded together by heat, radio-frequency welding, gluing, or a combination of these methods. Tube 110 is filled with a foam material such as polyurethane foam, or rubber latex foam (FIGS. 2, 3, and 5). Alternatively, tube 110' can be filled with air (FIG. 4).

Tube 110 can be formed by wrapping a piece of the above elastomeric material around a cylindrical piece of foam material and then welding the wrapped ends of the material together. Alternatively, tube 110 can be cast or extruded as a piece of tubing, or it can be formed around a tubular core. In all cases, tube 110 is sealed against the entry of water and is air-tight. In the case of an air-filled version, tube 110 includes an air valve (not shown) similar to a tire valve on a vehicle. The air valve is used for filling and emptying the sponson of air.

Attachment to a Personal Watercraft—FIGS. 4 through 7

A pair of drawstrings 106 and 116 (FIG. 4) are passed through channels or guides 105 and 115, respectively, using gravity or a draw wire. Each drawstring or tie is about 9.5 m long so that it extends out about 2 meters from each end of its channel. Each drawstring or tie should extend out from each end of its channel about one-half the width of the watercraft, plus sufficient length for knotting. Drawstrings 106 and 116 are preferably sheathed, nylon cords with a diameter between 3 and 6 mm, although other materials and sizes can be used.

FIG. 4 shows a cross-sectional view of a gunwale 130 of a personal watercraft. The sponson is attached to the watercraft by positioning channels 105 and 115 above and below the outer edge of gunwale 130, respectively. Drawstrings 106 and 116 are drawn tight, creating tensional forces that hold the sponson securely in place. Tube 110' of the sponson of FIG. 4 is shown filled with air, while tube 110 of FIGS. 2, 3, and 5 is shown as filled with foam.

Alternative Embodiment

Description and Attachment—FIG. 5

FIG. 5 shows a cross-sectional view of a gunwale 130' with a sloping upper surface. In this case, an additional tie guide with a channel 120 is attached to the sponson in order to enable the sponson to be securely attached to the watercraft. This third tie guide with channel 120 is welded to tube 110 in the same fashion as were the tie guides with channels 105 and 115. Channel 120 is attached to the sloping portion of gunwale 130' by a fixture 125, such as an elongated groove or slot, which may be undercut. Channel 120 is inserted into groove 125 and is held by friction or snap fit. As in the previous embodiment, drawstrings 106 and 116 pass through channels 105 and 115 and are pulled tight to create tension that holds the sponson in place.

All Embodiments

Figure 6:
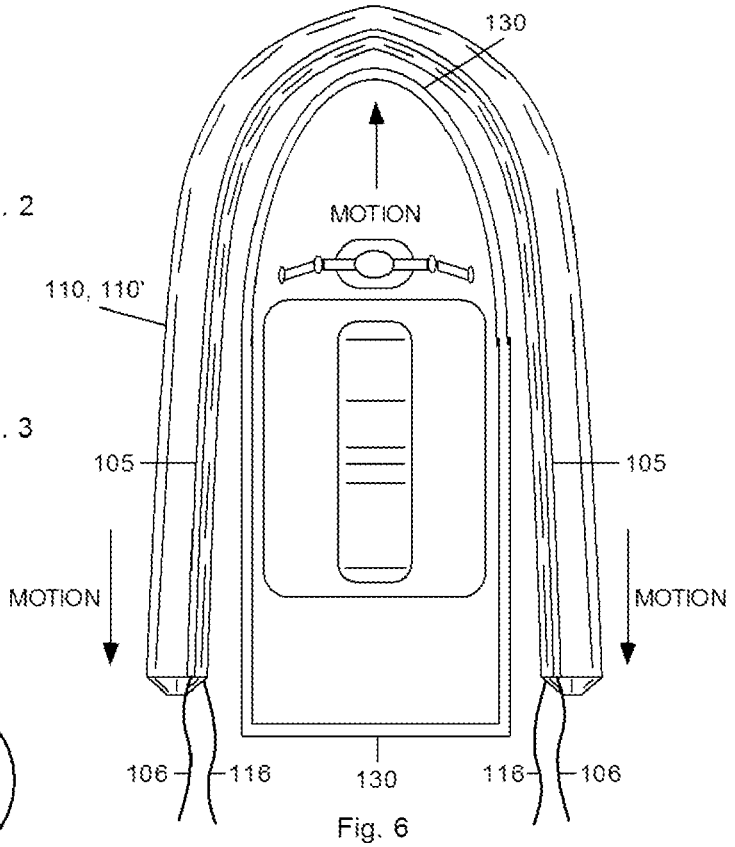
FIG. 6 shows the process of installing the first embodiment on a personal watercraft.
Figure 7:
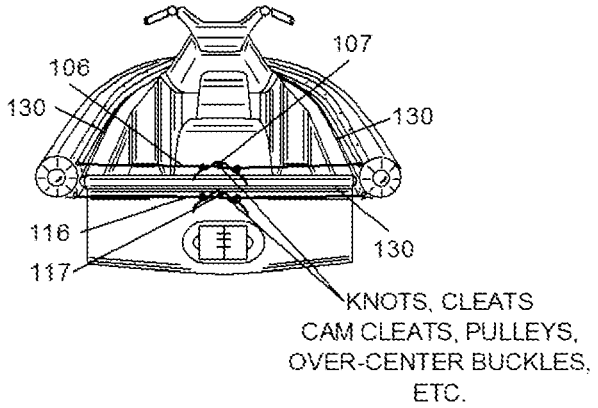
FIG. 7 shows a rear view of the watercraft of FIG. 6 after installation of the sponson.

Installation of the Sponson—FIGS. 6 and 7

The sponson can be used with many types of boats where additional buoyancy and collision protection are desired. It is most suited for use on small watercraft, such as jet skis, drift boats (dories or shallow-draft boats), Jon (flat bottom) boats, prams or dinghies, runabouts, and amphibious all terrain vehicles, such as those sold under the trademark Argo (www.Argo-boats.com). FIG. 6 shows a plan view of a generic watercraft and a sponson positioned for attachment to the watercraft and FIG. 7 shows a rear view of the watercraft with the sponson installed.

To install the sponson, the user first forms it into a U shape around the watercraft with channels 105 and 115 positioned above and below gunwale 130, respectively, as shown in FIG. 4. With the sponson in this position (FIG. 6) and the ends of the sponson at the two sides of the stern, the user then pulls the loose ends of drawstring 106 tightly together and ties a knot 107 (FIG. 7) in the middle of the stern, thereby partially securing the sponson to the watercraft. Next, the user does the same with drawstring 116, tying a knot 117 in the middle of the stern, below knot 116. The two taut and tied drawstrings above and below the gunwale hold the sponson tightly to the watercraft. This completes installation of the sponson on the watercraft.

Instead of knots 107 and 117, cleats, cam cleats, pulleys, over-center buckles, winches, and other methods of tensioning and tying can be used.

In the case of the alternative embodiment of FIG. 5, the user first secures drawstrings 106 and 116 as above, then secures channel 120 to fixture 125 which has been previously secured to gunwale 130'.

The sponson increases the buoyancy of the watercraft and provides collision and tip over protection, yet remains out of the water during normal forward travel. It does not introduce any drag since it is not in the water. The sponson can be attached without any change to the design of the watercraft The sponson thus provides a valuable safety feature for beginners using watercraft for the first time, and for all users in crowded spaces. All embodiments are easily removed and stored. In the case of the air-filled unit, the air can be released so the sponson can be compactly stored in a very small volume.

To remove the sponson from the watercraft (FIGS. 6 and 7), the user simply unties knots 107 and 117 and removes the sponson from the craft. If a fixture 125 is used, channel 120 is disengaged from fixture 125 prior to untying knots 107 and 117.

CONCLUSION, RAMIFICATIONS, AND SCOPE

Accordingly the reader will see that, according to one or more aspects, I have provided a sponson for a watercraft that is easily installed and removed. The sponson is securely yet easily attached to the craft and provides buoyancy and collision protection, yet remains out of the water during normal forward travel, thereby introducing no drag as the craft moves. The sponson is a valuable safety feature for beginners using watercraft for the first time, and for all users in crowded spaces. Both embodiments described are easily removed and stored. In the case of the air-filled unit, the air can be released so the sponson can be compactly stored in a very small volume. Our design is usable on a variety of watercraft without change to the design or the watercraft.

While the above description contains many specificities, these should not be construed as limitations on the scope, but as exemplifications of some presently preferred embodiments. Many other ramifications and variations are possible within the teachings. For example, all aspects of the preferred embodiment are scalable to any size. The sponson can be secured to other kinds of watercraft such as canoes, dinghies, and the like. It can be used on sail boats, manually powered boats, and motorboats. Instead of a cylindrical cross-section, the sponson can be square, triangular, or oval in shape. Instead of tying the drawstrings with knots, hooks, buckles, stretchable cords, cleats, winches, etc. can be used. Instead of tying the drawstrings in the middle of the stern they can be tied on a side of the boat or even at the bow. The drawstrings can be made of an elastic material instead of a non-stretchable material. The collar can be clamped or held by snaps, clips, or pegs or hooks through grommeted holes on one side and the drawstrings can be tied on the other side. The sponson can be painted decoratively or in colors for safety purposes. The sponson can be removed from the watercraft and used as an emergency flotation device. Storage pockets can be provided in the sponson for drinking water, flares, or other objects.

Thus the scope should be determined by the appended claims and their legal equivalents, and not only by the examples given.

The invention claimed is:

1. A sponson for a personal watercraft with a gunwale, comprising:

a tube with first and second ends, said tube being floatable and of sufficient length to wrap around the front and sides of said watercraft at said gunwale, upper and lower channels or guides attached to said tube and extending along the length of said tube and parallel to its central axis, a drawstring passing through each of said channels or guides and extending beyond the ends thereof, whereby when said sponson is positioned symmetrically around said front and sides of said watercraft against said gunwale, and said channels or guides are positioned above and below said gunwale, respectively, and said drawstrings are pulled taut and secured in a taut state, said sponson will be securely attached to said watercraft.

2. The sponson of claim 1 wherein said ends of said drawstrings are secured together by means selected from the group consisting of knots, cleats, cam cleats, pulleys, winches, and over-center buckles.

3. The sponson of claim 1 wherein said tube is filled with materials selected from the group consisting of air, foam, and a combination of air and foam.

4. The sponson of claim 1, further including at least one additional channel or guide attached to said sponson for attachment to a fixture attached to the upper surface of said gunwale of said watercraft when said gunwale has a sloping upper surface.

5. The sponson of claim 4 wherein said fixture is a groove or slots.

6. The sponson of claim 1 wherein said tube is made from materials selected from the group consisting of urethane-coated woven nylon fabric, vinyl, reinforced vinyl, and chlorosulfonated polyethylene.

7. The sponson of claim 1 wherein said channels are formed of material welded to said tube by means selected from the group consisting of heating, radio-frequency welding, gluing, and a combination thereof.

8. A method for attaching a sponson to a personal watercraft with a gunwale, comprising:

providing a sponson comprising a sealed tube and having upper and lower guideways or channels along its entire length, providing a drawstring through each of said guideways or channels and extending more than one-half the width of said watercraft beyond the ends of said sealed tube, forming said sponson symmetrically around the front and sides of said watercraft at said gunwale with said upper guideway or channel located above the level of said gunwale and said lower guideway or channel located below the level of said gunwale, pulling the ends of said drawstring in said upper guideway or channel taught and securing them together so that said upper guideway or channel is secured above said gunwale, pulling the ends of said drawstring in said lower guideway or channel taught and securing them together so that said lower eye is secured below said gunwale, thereby securing said sponson to said watercraft.

9. The method of claim 8 wherein said ends of said drawstrings are secured together by means selected from the group consisting of knots, cleats, cam cleats, pulleys, winches, and over-center buckles.

10. The method of claim 8 wherein said tube is filled with materials selected from the group consisting of air, foam, and a combination of air and foam.

11. The method of claim 8, further including at least one additional guideway or channel attached to said sponson for attachment to a fixture attached to the upper surface of said gunwale of said watercraft when said gunwale has a sloping upper surface.

12. The method of claim 11 wherein said fixture is selected from the group consisting of slots and grooves.

13. The method of claim 8 wherein said tube and said guideways or channels are made from materials selected from the group consisting of urethane-coated woven nylon fabric, vinyl, reinforced vinyl, and chlorosulfonated polyethylene.

14. A sponson for attachment to a personal watercraft having a gunwale extending around the perimeter of said watercraft, comprising:

an elongated, sealed cylinder with a plurality of guideways or channels attached to the sides of said cylinder and extending along its entire length, a plurality of drawstrings slidably placed within said respective guideways or channels, said drawstrings having ends extending beyond the ends of said cylinder a distance greater than one-half the width of the rear end of said personal watercraft, whereby when said sponson is symmetrically formed around said front and sides of said watercraft with a first of said guideways or channels lying above said gunwale and a second of said guideways or channels lying below said gunwale, and the ends of said drawstrings are pulled taut and secured across the rear end of said watercraft, said sponson is secured to said watercraft in order to protect said watercraft from damage incurred by colliding with obstacles and provide additional flotation and tip over protection.

15. The sponson of claim 14, further including at least one additional guideway or channel attached to said sponson for attachment to a fixture secured to the upper surface of said gunwale of said watercraft when said gunwale has a sloping upper surface.

16. The method of claim 15 wherein said fixture is selected from the group consisting of slots and grooves.

17. The sponson of claim 14 wherein said ends of said drawstrings are secured together by means selected from the group consisting of knots, cleats, cam cleats, pulleys, winches, and over-center buckles.

18. The sponson of claim 14 wherein said cylinder is filled with materials selected from the group consisting of air, foam, and a combination of air and foam.

19. The sponson of claim 18 where said foam is selected from the group consisting of polyurethane foam and latex foam.

20. The sponson of claim 14 wherein said cylinder and said eyes are made from materials selected from the group consisting of urethane-coated woven nylon fabric, vinyl, reinforced vinyl, and chlorosulfonated polyethylene.

* * * * *